US006665875B1

(12) United States Patent
Alonso et al.

(10) Patent No.: US 6,665,875 B1
(45) Date of Patent: Dec. 23, 2003

(54) PROTECTIVE GARMENT

(76) Inventors: Almeda Alonso, 19 Lindsey Ct., Pleasant Hill, CA (US) 94523; Thomas Horner, 19 Lindsey Ct., Pleasant Hill, CA (US) 94523

( * ) Notice: Subject to any disclaimer, the term of this patent is extended or adjusted under 35 U.S.C. 154(b) by 0 days.

(21) Appl. No.: 10/114,305

(22) Filed: Apr. 1, 2002

(51) Int. Cl.[7] ..... A41D 13/04
(52) U.S. Cl. ..... 2/51; 2/46
(58) Field of Search ..... 2/48, 51, 46, 22, 2/24, 242, 455, 228, 238, 227, 79, 465, 911

(56) References Cited

U.S. PATENT DOCUMENTS

| | | | | | |
|---|---|---|---|---|---|
| 952,179 | A | * | 3/1910 | Beckmann | 2/51 |
| 1,404,987 | A | | 1/1922 | Lundqvist | |
| 1,411,562 | A | | 4/1922 | Christian | |
| 1,478,349 | A | | 12/1923 | Oberndorfer | |
| 2,446,006 | A | * | 7/1948 | Hendricks | 2/467 |
| 2,555,786 | A | | 6/1951 | Dasinger | |
| 3,517,394 | A | * | 6/1970 | Robinson | 2/51 |
| 4,266,299 | A | * | 5/1981 | Beal | 2/46 |
| 4,894,867 | A | * | 1/1990 | Ceravolo et al. | 2/238 |
| 4,923,247 | A | * | 5/1990 | Malmstrom | 297/4 |
| 4,984,303 | A | | 1/1991 | Ross | |
| D321,969 | S | | 12/1991 | Upthegrove et al. | |
| 5,095,544 | A | * | 3/1992 | Elverskog | 2/22 |
| 5,375,262 | A | | 12/1994 | Carter | |
| D399,336 | S | | 10/1998 | DeFino | |
| 6,175,959 | B1 | * | 1/2001 | Somers | 2/46 |
| 6,202,215 | B1 | | 3/2001 | Sauter | |

* cited by examiner

*Primary Examiner*—Tejash Patel
(74) *Attorney, Agent, or Firm*—Thomas R. Lampe

(57) ABSTRACT

A protective garment includes an apron portion and a pair of flexible leg protector members depending from the apron portion. Each leg protector member has a deformable, curved strip of material having an elastic memory connected thereto which releasably holds the leg protector members in position.

5 Claims, 1 Drawing Sheet

PROTECTIVE GARMENT

TECHNICAL FIELD

This invention relates to a protective garment for partially covering the clothing of an individual. The garment is useful, for example, for protecting and shielding the wearer's clothes from paint spatters and drips; however, it has application in any environment wherein clothing can be dirtied or stained.

BACKGROUND OF THE INVENTION

It is well known to provide protective or outer garments of various kinds to protect or shield the wearer's clothing. Some of these garments, for example, can be in the form of aprons, chaps and the like which serve to protect the front of the individual. Chaps are typically releasably secured to the legs of the individual by straps and other types of connectors which must be manually manipulated to apply or remove the garment. This can be a tiresome and relatively time consuming procedure in some cases.

The following patents disclose protective outerwear or garments which are believed to be representative of the current state of the prior art: U.S. Pat. No. 6,202,215, issued Mar. 20, 2001, U.S. Pat. No. 5,375,262, issued Dec. 27, 1994, U.S. Pat. No. 4,984,303, issued Jan. 15, 1991, U.S. Pat. No. 3,517,394, issued Jun. 30, 1970, U.S. Pat. No. 2,555,786, issued Jun. 5, 1951, U.S. Pat. No. 1,478,349, issued Dec. 18, 1923, U.S. Pat. No. 1,411,562, issued Apr. 4, 1922, U.S. Pat. No. 1,404,987, issued Jan. 31,1922, U.S. Pat. No. DES.399,336, issued Oct. 13, 1998, and U.S. Pat. No. DES.321,969, issued Dec. 3, 1991.

DISCLOSURE OF INVENTION

The protective garment of the present invention is easy to put on and to remove. The garment is characterized by its relative simplicity and effectiveness as well as by its ease of use.

The protective garment of this invention is for partially covering the clothing of an individual.

The protective garment includes an apron portion and apron portion securement means for releasably securing the apron portion to the waist of an individual.

A pair of flexible leg protector members depends from and extends downwardly from the apron portion for positioning over the front of the legs of the individual when the apron portion is releasably secured to the individual's waist by the apron portion securement means.

The leg protector members include upper leg protector member portions which do not extend completely about the individual's legs and lower leg protector member portions connected to said upper leg protector member portions which extend substantially completely about the individual's legs. Each of the lower leg protector member portions has distal ends positionable in back of the individual's legs.

Resilient securement means is connected to the lower leg protector member portions to releasably maintain the distal ends thereof in position in back of the individual's legs to releasably secure the lower leg protector member portions to the individual's legs.

Other features, advantages and objects of the present invention will become apparent with reference to the following description and accompanying drawings.

BEST MODE FOR CARRYING OUT THE INVENTION

Figure 1:
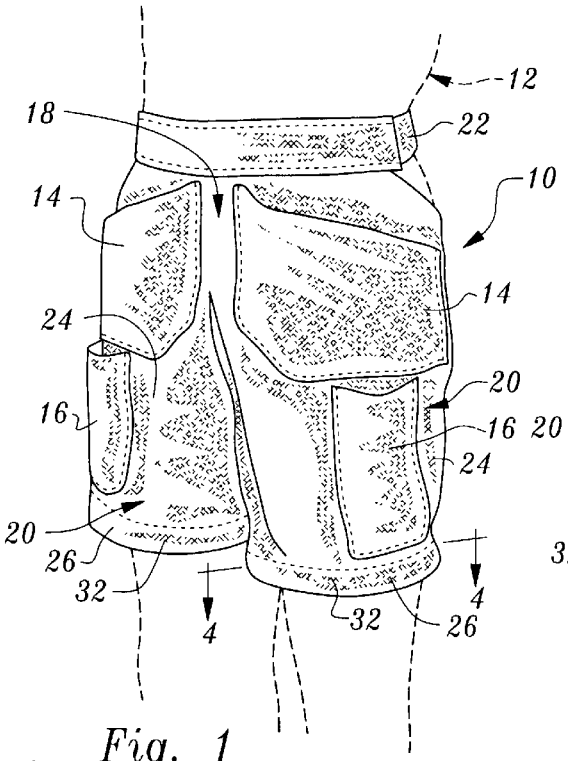
FIG. 1 is a frontal perspective view of a protective garment constructed in accordance with the teachings of the present invention worn by an individual, the latter indicated by dash lines.
Figure 2:
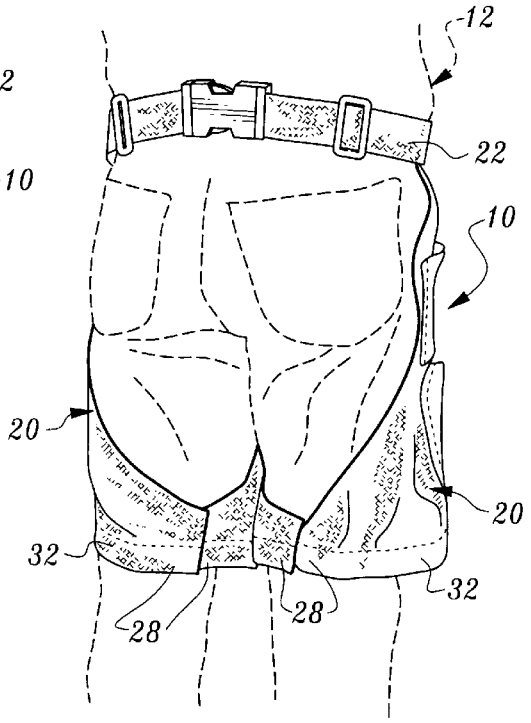
FIG. 2 is a rear perspective view of the protective garment worn by the individual.
Figure 3:
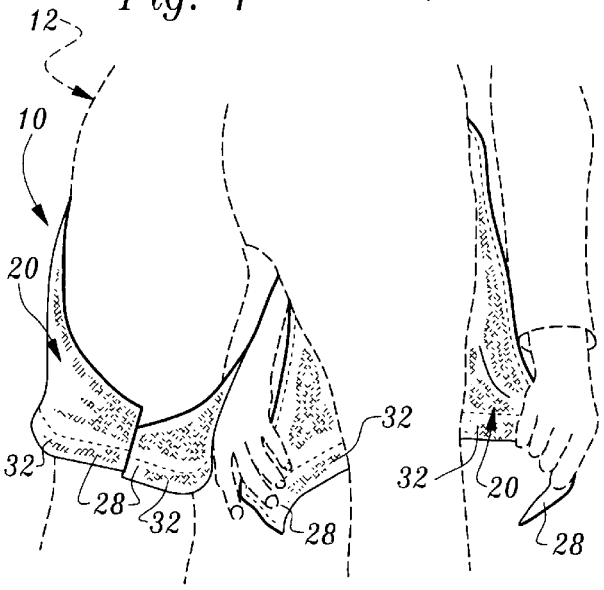
FIG. 3 is a rear perspective view illustrating one of the leg protector members of the protective garment in place on an individual's leg and the other leg protector member thereof illustrated being manipulated prior to placement on the individual's leg.

Referring now to the drawings, a protective garment constructed in accordance with the teachings of the present invention is designated generally by reference numeral 10. In FIGS. 1, 2 and 3, the garment 10 is being worn by an individual 12, indicated by dash lines.

The garment 10 is constructed of flexible material, preferably cloth such as heavy bull denim. The garment 10, in the form illustrated, includes pockets 14 and 16 used to hold tools and the like. The garment includes an apron portion 18 and a pair of flexible leg protector members 20 depending from and extending downwardly from the apron portion for positioning over the front of the individuals legs when the apron portion is releasably secured to the individual's waist by securement strap 22, as illustrated in FIGS. 1 and 2.

The leg protector members 20 include upper leg protector member portions 24 which do not extend completely about the individual's legs. The leg protector members also include lower leg protector member portions 26 integrally connected to the upper leg protector member portions which extend substantially completely about the individual's legs. Each of the lower leg protector member portions has distal ends 28 positionable behind or in back of the individual's legs, as shown in FIGS. 2 and 3, for example. In FIG. 3, one of the lower leg protector member portions 26 is in place on a leg while the other lower leg protector portion 26 is being manually manipulated prior to placement thereof about a leg.

Resilient securement means are connected to the lower leg protector member portions to releasably maintain the distal ends 28 thereof in position in back of the individual's leg to releasably secure the lower leg protector member portions to the individual's legs.

Figure 4A:
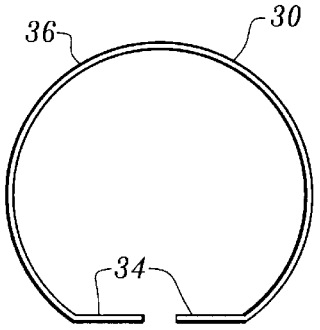
FIG. 4A is a plan view of a curved strip having elastic memory employed in the protective garment, the strip being shown in undeformed condition.
Figure 5:
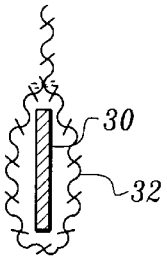
FIG. 5 is an enlarged cross-sectional view illustrating the strip in a garment receptacle.
Figure 4B:
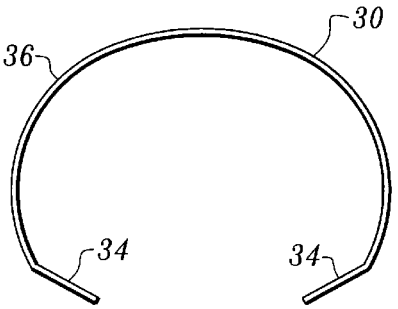
FIG. 4B is a view similar to FIG. 4A, but illustrating the strip in a deformed condition, such as that which occurs when opposed manual forces are applied to pull the free ends thereof away from one another.

More particularly, the resilient securement means comprises a deformable, curved strip of material having an elastic memory connected to each of the lower leg protector member portions 26. The strips are of identical construction and are illustrated in FIGS. 4A, 4B and 5, identified by reference numeral 30. Each of the lower leg protector member portions 26 defines a channel or receptacle 32 extending between the distal ends 28 thereof. One strip 30 is positioned in the receptacle of each of the lower leg protector member portions.

The strips 30 may suitably be constructed of plastic. The strips are deformable and the plastic or other material of which they were made has an elastic memory. FIG. 4A shows the normal position assumed by a strip 30. The strip

30 includes straight end segments 34 and a curved intermediate segment 36 between the straight end segments. The strips are of integral construction.

When the protective garment 10 is fully in place on the individual as shown in FIGS. 1 and 2, the straight end segments are positioned in back of the knees of the wearer. This placement adds to the comfort of the wearer since the strips 30 are not in a position to interfere with bending of the knees. That is, since the straight end segments are closer to the back of the knee than would be the case if the strips were perfectly round, the strips will not be in a position where they are likely to be pinched between the upper leg and the lower leg when bending occurs.

This strip configuration also performs the important task of positively holding the leg protector members in place and keeping them from shifting.

Placement of the leg protector members on the leg is simplicity itself, the individual merely pulling the free ends of lower leg protector member portions and the strips associated therewith away from one another, as shown with respect to one of the lower protector member portions in FIG. 3, and allowing the strips to return to their normal configuration after such placement has occurred. Removal of the leg protective members is also very simple, the wearer merely having to grasp the fronts of the leg protector members and pull them forwardly. The flexible strips 30 will readily be pulled open due to engagement with the wearer's legs to allow removal of the lower leg protector member portions from the legs.

The invention claimed is:

1. A protective garment for partially covering the clothing of an individual, said protective garment comprising, in combination:

an apron portion;

apron portion securement means for releasably securing said apron portion to the waist of an individual;

a pair of flexible leg protector members depending from and extending downwardly from said apron portion for positioning over the fronts of the legs of the individual when said apron portion is releasably secured to the individual's waist by said apron portion securement means, said leg protector members including upper leg protector member portions which do not extend completely about the individual's leg and lower leg protector member portions connected to said upper leg protector member portions which extend substantially completely about the individual's legs, each of said lower leg protector member portions having distal ends positionable in back of the individual's legs; and resilient securement means connected to said lower leg protector member portions to releasably maintain the distal ends thereof in position in back of the individual's legs to releasably secure the lower leg protector member portions to the individual's legs, said resilient securement means comprising a deformable, curved strip of material having elastic memory connected to each of said lower leg protector member portions.

2. The protective garment according to claim 1 wherein each of said lower leg protector member portions defines a receptacle extending between the distal ends thereof, said deformable, curved strip of material positioned in and retained by said receptacle.

3. The protective garment according to claim 1 wherein said deformable, curved strip of material includes substantially straight end segments and a curved intermediate segment between said substantially straight end segment.

4. The protective garment according to claim 3 wherein the substantially straight end segments of said deformable, curved strip of material are positioned behind the knee of the individual when said apron portion is releasably secured to the individual's waist.

5. The protective garment according to claim 1 wherein said deformable, curved strip of material is plastic.

* * * * *